United States Patent [19]

Sakuragi

[11] Patent Number: 4,955,735

[45] Date of Patent: Sep. 11, 1990

[54] PRINTER WITH COMBINED DATA AND OPERATING-MODE DISPLAY

[75] Inventor: Shoji Sakuragi, Nagoya, Japan

[73] Assignee: Brother Kogyo Kabushiki Kaisha, Nagoya, Japan

[21] Appl. No.: 319,702

[22] Filed: Mar. 7, 1989

[30] Foreign Application Priority Data

Mar. 17, 1988 [JP] Japan ..... 63-64083

[51] Int. Cl.[5] ..... B41J 3/46

[52] U.S. Cl. ..... 400/83; 340/711

[58] Field of Search ..... 400/83, 485, 486; 340/706, 792, 711, 712, 716, 720, 475, 464; 200/308–317, DIG. 47; 166/290; 90/446; 341/23

[56] References Cited

U.S. PATENT DOCUMENTS

| | | | |
|---|---|---|---|
| 4,124,843 | 11/1978 | Bramson | 400/83 |
| 4,468,754 | 8/1984 | Asada | 400/83 |
| 4,504,825 | 3/1985 | Bergermann et al. | 400/83 |
| 4,528,560 | 7/1985 | Bergermann | 400/83 |
| 4,590,560 | 5/1986 | Sado | 400/83 |
| 4,624,587 | 11/1986 | Ueno | 400/83 |
| 4,728,964 | 3/1988 | Sasaki | 400/76 |

FOREIGN PATENT DOCUMENTS

| | | | |
|---|---|---|---|
| 0112060 | 11/1983 | European Pat. Off. | 400/83 |

*Primary Examiner*—David A. Wiecking
*Assistant Examiner*—Steven S. Kelley
*Attorney, Agent, or Firm*—Oliff & Berridge

[57] ABSTRACT

A printer that uses a display panel for displaying either input data or pointers that indicate current operating modes. This innovation reduces both the required space and the manufacturing cost for the display panel.

8 Claims, 7 Drawing Sheets

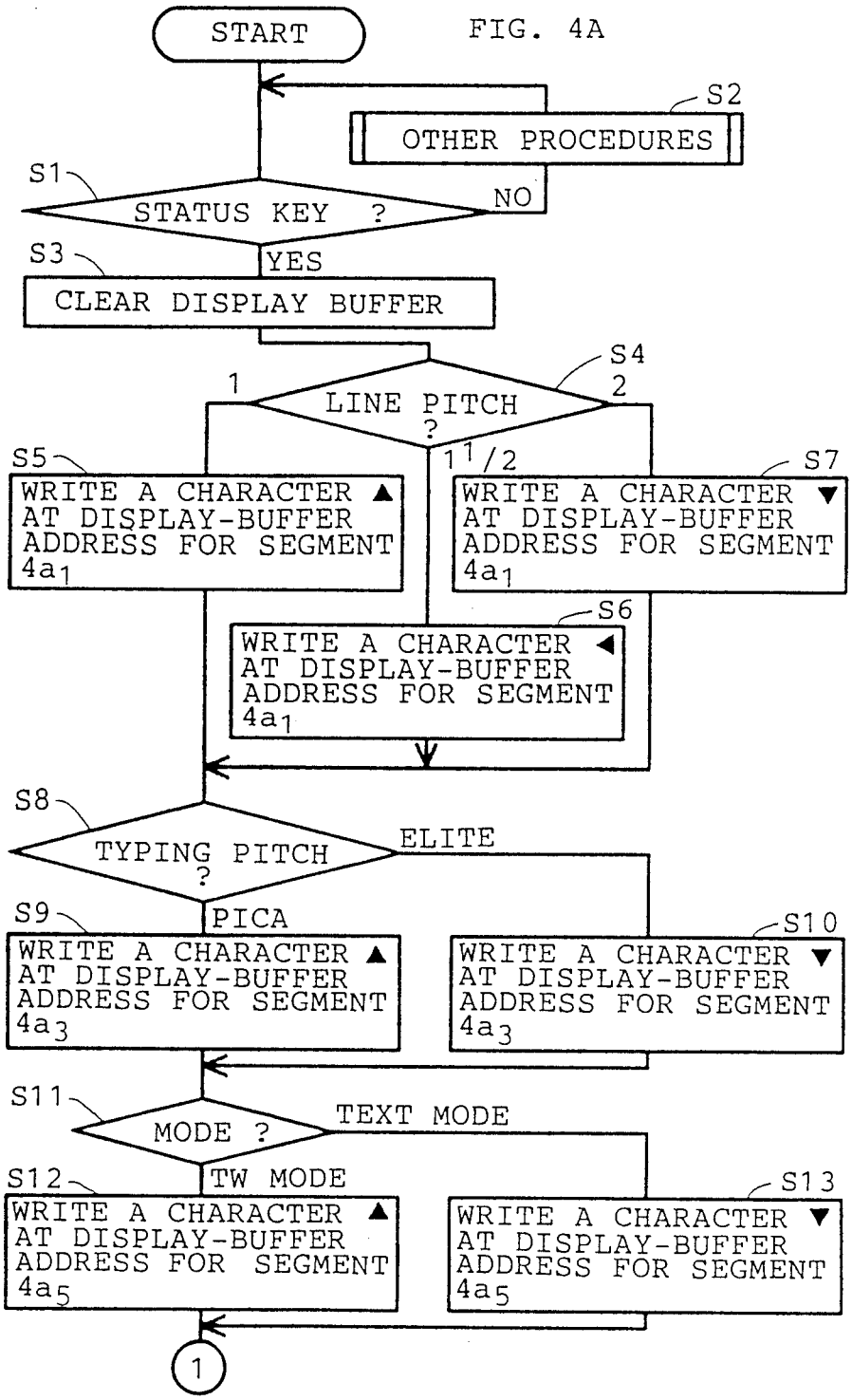
START
FIG. 4A
S2
OTHER PROCEDURES
S1
STATUS KEY ?
NO
S3
YES
CLEAR DISPLAY BUFFER
S4
1
LINE PITCH ?
2
1 1/2
S5
WRITE A CHARACTER ▲ AT DISPLAY-BUFFER ADDRESS FOR SEGMENT 4a1
S7
WRITE A CHARACTER ▼ AT DISPLAY-BUFFER ADDRESS FOR SEGMENT 4a1
S6
WRITE A CHARACTER ◀ AT DISPLAY-BUFFER ADDRESS FOR SEGMENT 4a1
S8
TYPING PITCH ?
ELITE
S9
PICA
WRITE A CHARACTER ▲ AT DISPLAY-BUFFER ADDRESS FOR SEGMENT 4a3
S10
WRITE A CHARACTER ▼ AT DISPLAY-BUFFER ADDRESS FOR SEGMENT 4a3
S11
MODE ?
TEXT MODE
S12
TW MODE
WRITE A CHARACTER ▲ AT DISPLAY-BUFFER ADDRESS FOR SEGMENT 4a5
S13
WRITE A CHARACTER ▼ AT DISPLAY-BUFFER ADDRESS FOR SEGMENT 4a5
1

PRINTER WITH COMBINED DATA AND OPERATING-MODE DISPLAY

FIELD

The instant invention is directed to a printer with a display panel for showing both input data and various printer operating modes.

PRIOR ART

Printers of this kind usually have several operating modes such as pica and elite typing-pitch modes, various line-spacing modes, character-feature modes, a type/text mode, etc. Such printers often have a display panel for showing characters entered on the keyboard. This display panel improves the facility of the printer.

Techniques for improving the facility of the printer even more have been proposed. One printer, for example, has indicator LEDs and a liquid-crystal panel arranged in parallel so the user can identify the current operating modes. This printer lights up the indicator LEDs corresponding to the current operating modes so the user can tell in a glance which operating modes ar currently employed.

This prior-art printer requires both a display panel for the input data and as many LEDs as there are operating modes. A large space on the printer must be devoted to this purpose, complicating the structure of the printer, and increasing its size and manufacturing cost. To solve this problem, I have invented a printer that shows the user the current operating modes without any dedicated indicators.

SUMMARY

The printer according to the instant invention has an input display driver M1, shown in FIG. 1, that displays on a display panel D data from a keyboard KB, and a mode executor M2 for executing the modes a user selects from a set of operating modes. The printer has a marked border M3 with marks arranged around the display panel D, each mark corresponding to one operating mode, and a mode display driver M4 for displaying pointers on the display panel D that point out the marks on the marked border M3 corresponding to the currently selected operating modes. The mode display driver M4 overrides the input display driver M1 at a command from the user.

During ordinary typing, the input display driver M1 displays characters from the keyboard KB. The user may press a dedicated key to learn what operating modes the mode executor M2 is currently executing. The mode display driver M4 displays pointers on the display panel D, overriding the input display driver M1. The pointers point at marks on the marked border M3 surrounding the display panel D. In this manner, the printer displays the current operating modes.

DESCRIPTION OF THE DRAWINGS

FIGS. 4A and 4B together form a flowchart of a process for displaying the operating modes of the electronic typewriter.

EMBODIMENTS

In an electronic typewriter 1, a liquid-crystal panel 4 with sixteen consecutive display segments 4a ($4a_1$–$4a_{16}$) displays characters entered on a keyboard 2. The keyboard 2 has several dedicated mode keys: a key PK for switching between pica pitch and elite pitch; a key BK for choosing bold typing; a key UK for choosing an underline typing (UNDLN mode); a key LK for choosing line-by-line printing (L/L mode); a key WK for checking spelling (W.SP mode); a key LPK for switching line pitch between single space, space-and-a-half, and double space; a key AK for setting an automatic carriage-return mode (AUTO mode); and a key TK for switching between typing (TW mode) and text-accumulation (TEXT mode). A status key SK switches between displaying the input display driver M1 and the mode display driver M4 on the display panel 4.

Figure 1:
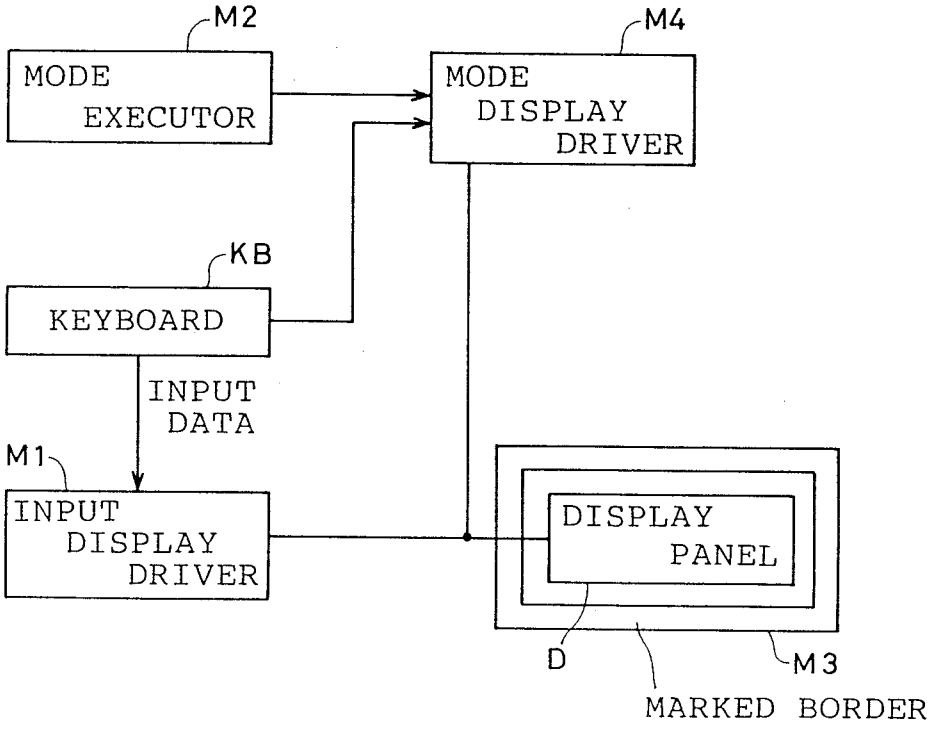
FIG. 1 is a simple block diagram of the invention.
Figure 2A:
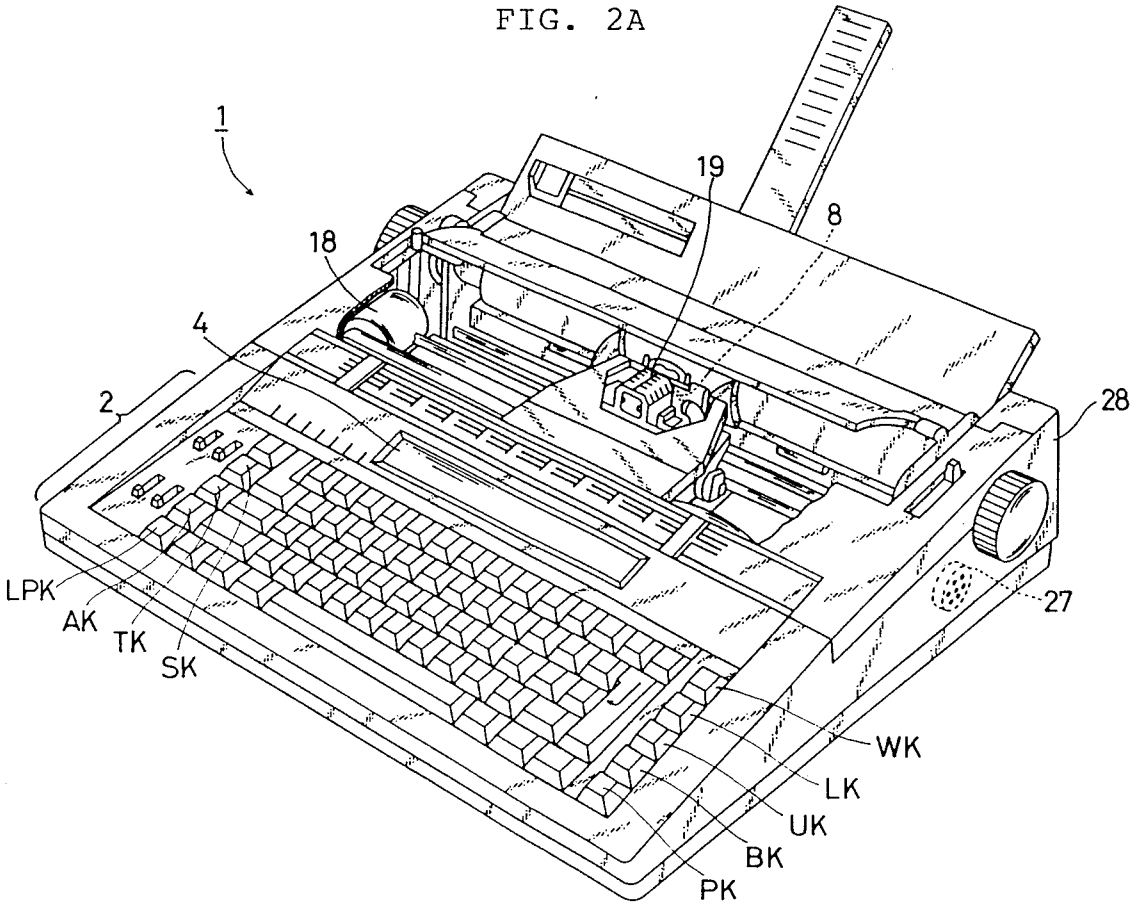
FIG. 2A is a perspective view of an electronic typewriter embodying the instant invention.
Figure 2B:
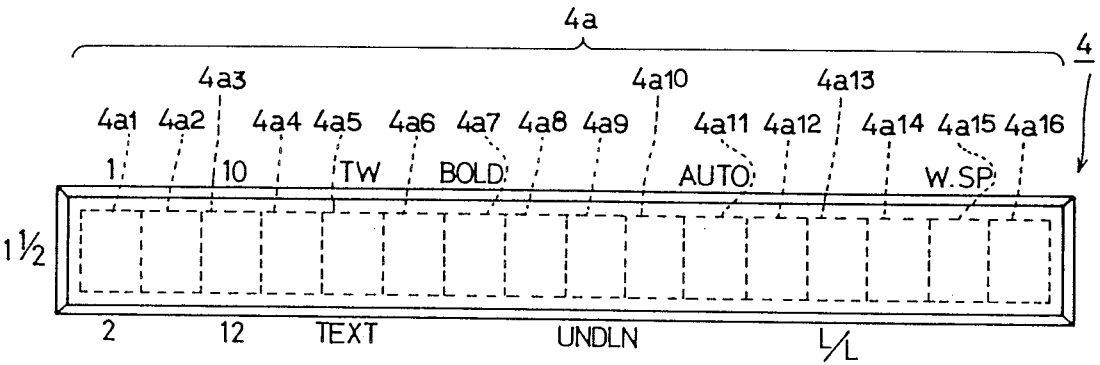
FIG. 2B is an enlarged view of the display panel and bordering marks from FIG. 2A.

Marks corresponding to the various operating modes are imprinted on the part of the case 28 bordering the display panel 4, shown in FIG. 2B, above, below, or beside the display segments. One display segment $4a_1$ has three numeral marks: "1" above, "1½" beside, and "2" below corresponding to the single-space, space-and-a-half, and double-space line pitches, respectively. Another segment $4a_3$ has a mark "10" above indicating pica pitch, and a mark "12" below indicating elite. A third segment $4a_5$ is marked "TW" and "TEXT"; a fourth $4a_7$, "BOLD"; a fifth $4a_9$ "UNDLN"; a sixth $4a_{11}$, "AUTO"; a seventh $4a_{13}$, "L/L"; and an eighth $4a_{15}$ is marked "W.SP".

Figure 3:
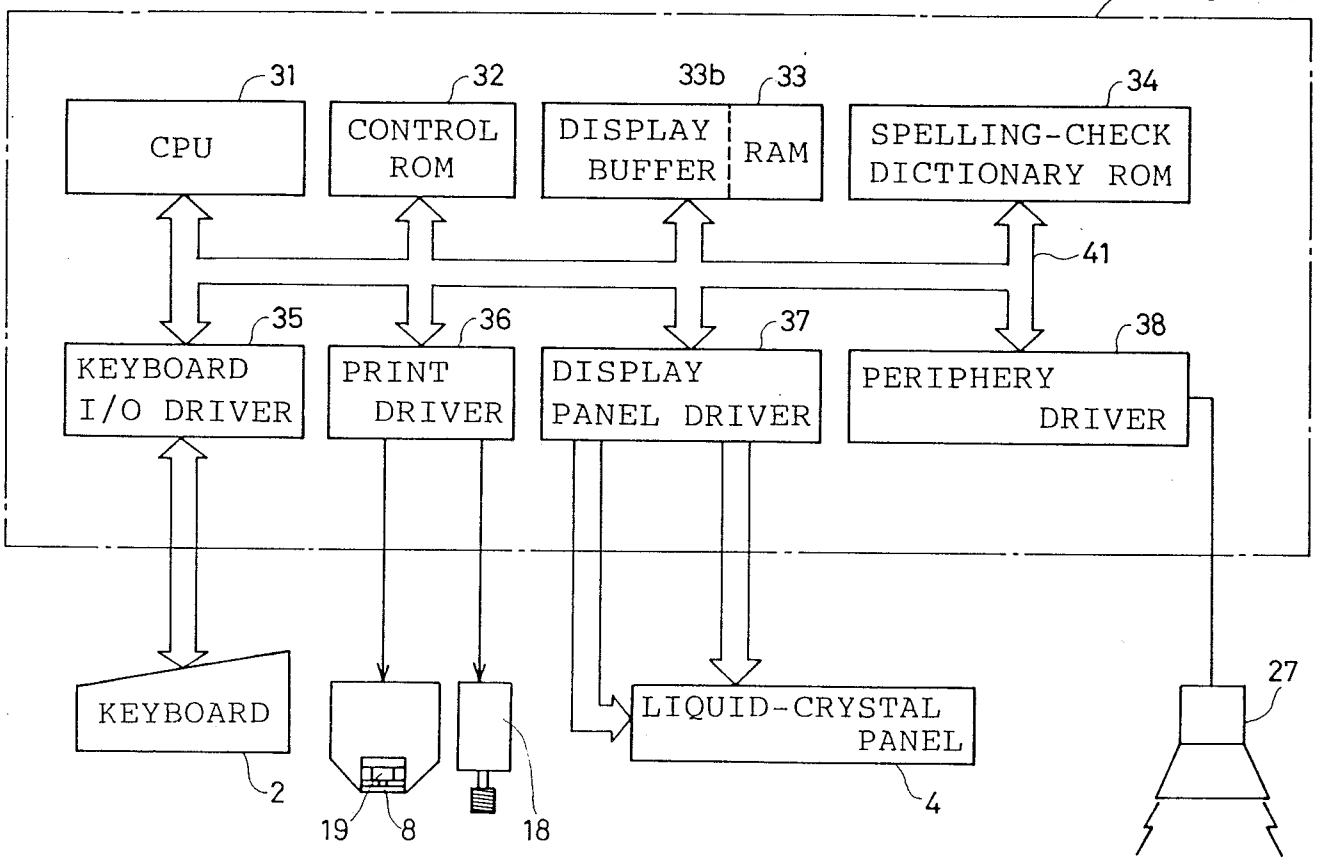
FIG. 3 is a block diagram of the electronic control unit for the typewriter.

FIG. 3 shows an electronic control unit 3 with a known CPU 31, a control ROM 32 with control programs and a character memory, RAM 33, and a spelling-check dictionary ROM 34. Other components might include a keyboard input/output driver 35, a print driver 36 for driving a daisy wheel 8, a stepping motor 18, and a print hammer 19, a display panel driver 37, and a periphery driver 38 for driving peripheries like a buzzer 27. These components are interconnected through a bus 41.

Figure 4B:
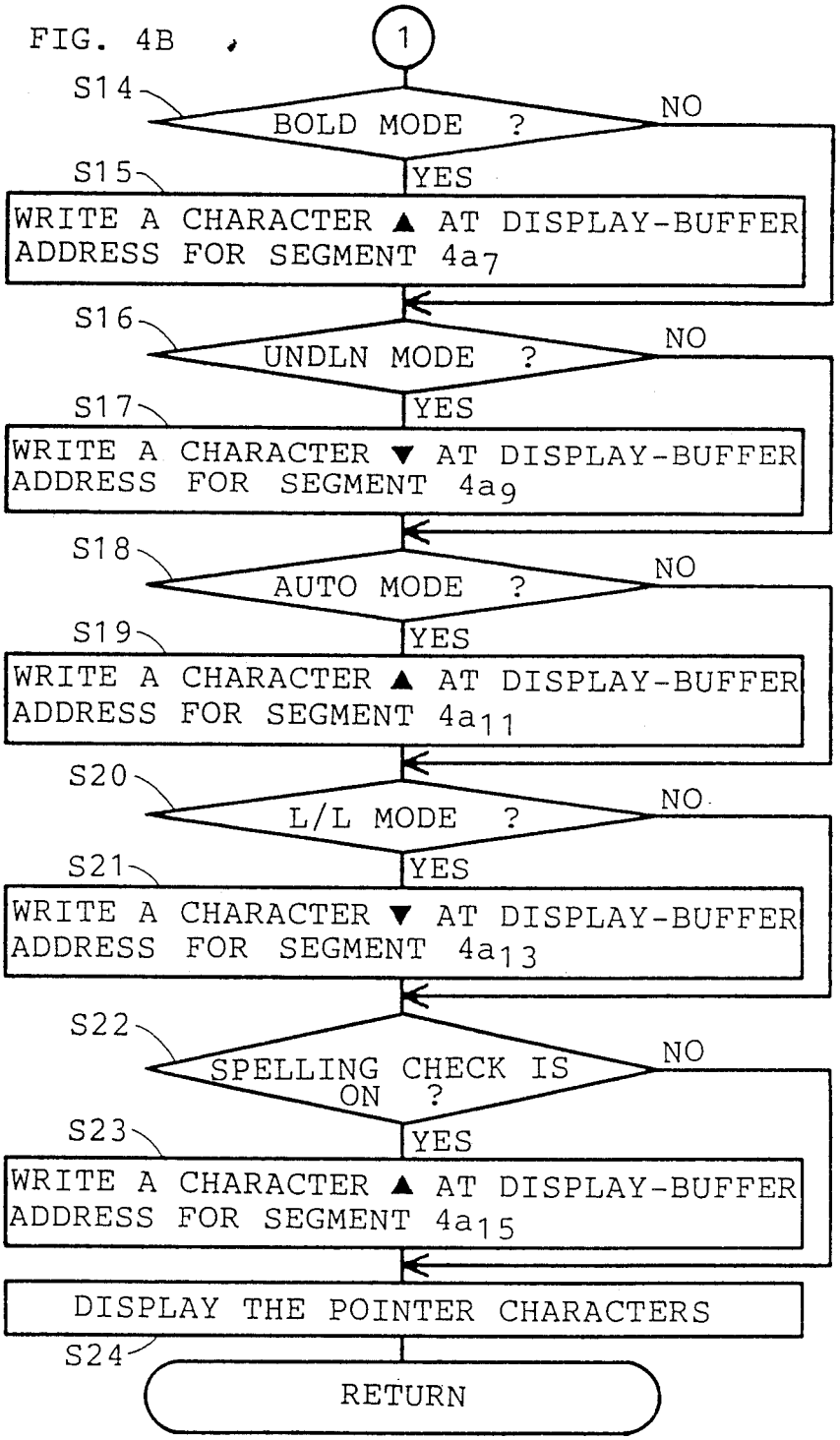

FIGS. 4A and 4B show a process for displaying the current operating modes. The CPU 31 determines if the user has pressed the status key SK at step 1 (hereinafter S1; likewise step X is denoted SX, where X is an integer). If the status key SK has not been pressed, the CPU 31 continues to execute other procedures at S2 until the status key SK is pressed. When the status key SK is pressed, the display buffer 33*b* in the RAM 33 is cleared in S3, thus deleting the input characters from the display panel 4.

In S4 through S13, the CPU 31 determines the selected alternative modes, and sets the appropriate pointers. At S4, the CPU 31 determines which line pitch is currently employed. If it is the single-space line pitch, then in S5, the CPU 31 writes an up-pointer character ▲ at the display-buffer 33*b* address corresponding to the first display segment $4a_1$ of the display panel 4. Similarly, in S6 the CPU 31 sets a left pointer ◀ for the space-and-a-half line pitch, and in S7 sets a down pointer ▼ for the double-space line pitch. Next, the CPU 31 determines which typing pitch is currently employed. For pica, the CPU 31 sets an up-pointer character ▲ in the display-buffer 33*b* address for a second display segment $4a_3$ in S9; for elite, a down pointer ▼ is set in S10. Finally, the CPU determines whether TW mode or TEXT mode is employed. If TW mode is current, the CPU 31 writes an up-pointer character ▲ to the display-buffer 33*b* address for a third display segment $4a_5$ in S12; otherwise, TEXT mode is current and the CPU 31 sets a down pointer ▼ in S13.

At S14 through S23, the CPU 31 determines the selected optional modes, and sets pointers as appropriate. If the BOLD mode is current in S14, an up-pointer character ▲ is written to the display-buffer 33*b* address for a display segment $4a_7$ in S15. Similarly, if UNDLN mode is current in S16, a down pointer ▼ is set in a display segment $4a_9$ in S17; if AUTO mode is current in S18, an up pointer ▲ is set in a display segment $4a_{11}$ in S19; if L/L mode is current in S20, a down pointer ▼ is set in a display segment $4a_{13}$ in S21; and if the spell checking is on in S22, an up pointer ▲ is set in a display segment $4a_{15}$ in S23.

In S24, the pointer characters thus stored in the display buffer 33*b* are displayed in their respective display segments of the display panel 4, and the process ends. When the user presses any of the mode-selection keys (LPK, PK, TK, BK, UK, or AK) the mode-display process runs to display the updated mode settings just as though the status key SK were pressed.

Figure 5:
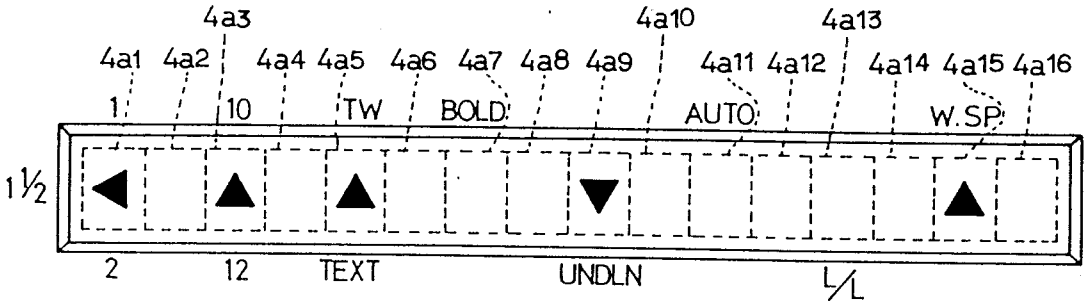
FIG. 5 is an example of the mode display in operation.

For illustration, suppose that this mode-display process is executed when the space-and-a-half line pitch, the pica type pitch, TW mode, underline mode, and spell checking are all current. In that case, when the selection key SK is pressed, the display panel 4 would display the settings shown in FIG. 5. Each current mode would be represented by the appropriate mark in the appropriate display segment. In this manner, the printer would show all the currently selected operating modes.

Other modes are, of course, possible; this embodiment leaves plenty of room for expansion. For instance, a centering mode could be added as an optional mode. A right-side, left-side, or both-side justification mode could be added as a second three-way alternative mode, with its pointer located in an end display segment $4a_{16}$. The current embodiment has the advantage that by using alternating display segments, the user can more readily distinguish adjacent pointers.

Figure 6:
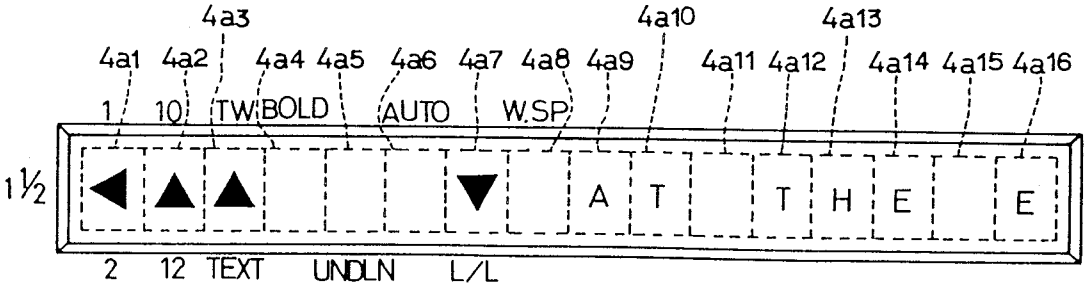
FIG. 6 shows a display panel that is split to simultaneously show text and pointers.

The marks are deliberately kept simple to save space in the character memory in the ROM 32 for storing the dot patterns, but more complex indicators are possible. Other useful modifications of the instant invention include:

using only display segments $4a_1$ through $4a_8$ for displaying the current operating modes on command, as shown in FIG. 6, so display segments $4a_9$ through $4a_{16}$ always display the most recently entered characters, and the user can see both the current modes and the latest entry; or dividing the display panel into upper and lower tiers with the modes listed in the upper tier and the input data in the lower tier so the user can identify operating modes such as a print mode while checking the input data.

Many modifications in addition to those I have listed are possible. This embodiment in no way limits my claims. The scope of my invention is limited only by my claims.

I claim:

1. A printer having input-display means for displaying data from a keyboard on a display panel and mode-executing means for executing at least one mode chosen from a set of many operating modes, the printer comprising:

the display panel having a single line of discrete display segments;

marks arranged above, below, and/or on at least one side of the display panel and placed adjacent to one of the discrete display segments, each mark representing a different operating mode; and mode-displaying means for overriding the input display means so that no input data is displayed on said single line of discrete display segments and for displaying only operating modes on the display panel by indicating marks corresponding to currently selected operating modes executed by the mode-executing means when a dedicated key on the keyboard is pressed;

wherein the mode-display means displays operating modes by displaying an indication character in display segments adjacent to the marks corresponding to the operating modes to be displayed, each indication character selectively pointing to one of the marks corresponding to a currently selected operating mode.

2. A printer, as in claim 1, where the display panel is a single line of liquid-crystal display segments.

3. A printer as in claim 2, in which at least one mode has two alternatives, the marks for those alternatives are arranged above and below the display segment corresponding to that mode, and the indication character in the display segment can indicate either alternative.

4. A printer, as in claim 1, wherein the display panel comprises two end discrete display segments and at least one middle discrete display segment, and the mode-display means displays indication characters in the at least one middle display segment pointing to a mark above or a mark below the at least one middle display segment, and indication characters in the end display segments point to a mark above, a mark below, or a mark on a side of the end display segments.

5. A printer, as in claim 4, wherein the set of operating modes contains at least one independent operating mode, where, when the mode display means overrides the input-display means, an indication character points to the mark corresponding to the at least one independent operating mode when the at least one independent operating mode is selected and the display segment adjacent to the mark corresponding to the at least one independent operating mode is blank when the at least one independent operating mode is not selected.

6. A printer, as in claim 4, wherein the set of operating modes contains at least one pair of alternative operating modes, with the printer operating in only one of the two alternative operating modes at a time, and marks corresponding to the two alternative operating modes are respectively arranged above and below the same discrete display segment and the mark corresponding to the selected alternative operating mode is pointed to by an indication character displayed in the same display segment.

7. A printer, as in claim 4, wherein the set of operating modes contains at least one subset of three alternative operating modes, with the printer operating in only one of the three alternative operating modes at a time, and marks corresponding to the three alternative modes are respectively arranged above, below, and on a side of the same end discrete display segment, and the mark corresponding to the selected alternative operating mode is pointed to by an indication character displayed in the same display segment.

8. A printer having input-display means for displaying data from a keyboard on a display panel and mode executing means for executing a mode chosen from a set of many operating modes, the printer comprising:

the display panel having discrete display segments;

marks arranged around the display panel, each mark representing a different operating mode; and mode-display means for overriding the input display means so that no input data is displayed on the discrete display segments of the display panel and for displaying only operating modes on the display panel by indicating marks corresponding to currently selected operating modes in the mode-executing means when dedicated keys on the keyboard are pressed;

wherein at least one mode of the set of operating modes has two alternatives, the marks for those alternatives are respectively arranged above and below a display segment which corresponds to that mode, and the mode-display means can indicate marks corresponding to either alternative.

* * * * *